US005470700A

United States Patent [19]

Marui

[11] Patent Number: 5,470,700

[45] Date of Patent: Nov. 28, 1995

[54] LIGHT-SENSITIVE SILVER HALIDE X-RAY PHOTOGRAPHIC MATERIAL CONTAINING A MIXTURE OF TABULAR GRAINS

[75] Inventor: Toshiyuki Marui, Tokyo, Japan

[73] Assignee: Konica Corporation, Japan

[21] Appl. No.: 324,770

[22] Filed: Oct. 17, 1994

Related U.S. Application Data

[63] Continuation of Ser. No. 110,637, Aug. 23, 1993, abandoned, which is a continuation of Ser. No. 772,936, Oct. 8, 1991, abandoned.

[30] Foreign Application Priority Data

Oct. 12, 1990 [JP] Japan ..... 2-274019

[51] Int. Cl.[6] ..... G03C 1/035; G03C 5/16

[52] U.S. Cl. ..... 430/567; 430/571; 430/966

[58] Field of Search ..... 430/509, 567, 430/571, 966

[56] References Cited

U.S. PATENT DOCUMENTS 4,731,322 3/1988 Suzuki et al. ..... 430/567

4,997,750 3/1991 Dickerson et al. ..... 430/509

FOREIGN PATENT DOCUMENTS 437117 7/1991 European Pat. Off. ..... 430/966

*Primary Examiner*—Janet C. Baxter

*Attorney, Agent, or Firm*—Jordan B. Bierman; Bierman and Muserlian

[57] ABSTRACT

Disclosed is a light-sensitive silver halide X-ray photographic material comprising a mixture of tabular silver halide grains, wherein tabular silver halide grains of 0.6 μm to 1.5 μm in an average grain size are contained in a proportion of 70% to 95% and of 0.3 μm to 0.5 μm in a proportion of 5% to 30%; the aspect ratio of tabular grains is more than 3; and having sensitometric properties in which a gamma (γ1) formed by a straight line portion between two points 0.5 and 1.5 of optical density is 2.7 to 3.3 and a gamma (γ2) formed by a straight line portion between points 2.0 ana 3.0 of optical density is 1.5 to 2.5 in the characteristic curve of a rectangular coordinate system having equal coordinate axis unit lengths for the optical density (D) and the amount of exposure (log E). A light-sensitive silver halide X-ray photographic material according to this invention has a superior diagonostic performance, and is improved in sharpness and graininess and also improved in pressure resistance.

9 Claims, No Drawings

LIGHT-SENSITIVE SILVER HALIDE X-RAY PHOTOGRAPHIC MATERIAL CONTAINING A MIXTURE OF TABULAR GRAINS

This application is a continuation of application Ser. No. 08/110637 filed Aug. 23, 1993, now abandoned, which is a continuation of application Ser. No. 07/772936 filed Oct. 8, 1991, now abandoned.

FIELD OF THE INVENTION

The present invention relates to a light-sensitive silver halide X-ray photographic material having a superior diagnostic performance. More particularly, it relates to a light-sensitive silver halide X-ray photographic material improved in sharpness and graininess and also improved in pressure resistance.

BACKGROUND OF THE INVENTION

In light-sensitive silver halide X-ray photographic materials for medical use, images are required to have a good sharpness and an excellent graininess so that niduses can be early detected and also misdiagnosis can be prevented in the photographing of any parts of living bodies.

The sharpness and graininess of light-sensitive materials influence the clearness of an image and the amount of its information, and hence are very important for improving the diagnostic performance.

In general, the parts of living bodies on which X-ray photographs are most often taken are the stomach, the chest and the bones in hand and foot. In order to improve the diagnostic performance in the photographing of them, it is necessary to give an image having a broad latitude of exposure over a low-density region to a high-density region, also having an appropriate density, free from fill-in or blank areas, and having a good sharpness.

As a parameter that determines the latitude of exposure of light-sensitive materials, gamma (γ) is used. In presently commercially available light-sensitive materials for X-ray photography can be roughly grouped in three types, the high-γ film, the low-γ film and the medium-γ film, which are used properly according to purpose. In these films, the high-γ type has an excellent sharpness but on the other hand has the disadvantage that a low-exposure area may be filled in to decrease the amount of information. The low-γ type can enjoy a satisfactory amount of information because of its broad latitude of exposure but may lack in sharpness. The medium-γ type is on a middle level in both the sharpness and the latitude of exposure. Thus, under existing circumstances, they have merits and demerits.

A great number of techniques have been hitherto proposed to make progress or improvement in photographic performance, e.g., contrast and good graininess and sharpness in respect of silver halide emulsions. For example, the present applicant has disclosed in Japanese Patent Publication Open to Public Inspection (hereinafter referred to as "Japanese Patent O.P.I. Publication") No. 214027/1984, a light-sensitive silver halide X-ray photographic material in which gamma obtained using a specific developing solution is defined, or in Japanese Patent O.P.I. Publication No. 116346/1986 the one in which gammas (γ1 to γ3) in specific regions are defined.

Including these techniques, however, most of conventional techniques have a difficulty in satisfying both the sharpness and the latitude, and, under actual circumstances, have not succeeded in achieving a high diagnostic performance in all instances where any of the aforesaid parts of living bodies are photographed.

Meanwhile, in parallel with the gamma (γ), light-sensitive materials for X-ray photography are required to have a high sensitivity since a radiation exposure must be decreased.

Films with high sensitivity, all of which make use of silver halide grains with a large grain size, are disadvantageous in that they commonly have a poor resistance to mechanical pressure, compared with films making use of small-size grains.

For example, in the case of X-ray films, they frequently undergo mechanical pressure when mechanically transported in automatic exposure or automatic developing, or are folded or bent when sheetlike films are manually directly handled.

The pressure applied to films on such various occasions is known to cause changes in the photographic performance of silver halide grains, as reported in detail in, for example, K. B. Mather, J. Opt. Soc. Am. 38, 1054 (1948), P. Faelens and P. de Smet, Sci. et Ind. Phot. 25, No. 5, 175 (1954) and P. Faelens, J. Phot. Sci., 2, 105 (1954).

In the case of X-ray films, there is a possibility that a serious difficulty occurs in diagnosis when the part subjected to the pressure has been blackened. Hence, it is earnestly sought to provide a light-sensitive material whose photographic performance can not be adversely affected at all by the pressure applied.

As methods of improving pressure resistance, a number of techniques have been already proposed. Most of them rely on approaches from physical properties, making utilization of an adsorptivity reducing compound with which silver halide surfaces are covered, or a binder component. Hence, most of them have damaged any photographic performance, and the advent of a new technique has been strongly sought thereon together with the improvement in the sharpness and the latitude.

SUMMARY OF THE INVENTION

Accordingly, a first object of the present invention is to provide a light-sensitive silver halide X-ray photographic material having a high sharpness and also having a broad latitude of exposure at the low-density portion and the high-density portion.

A second object of the present invention is to provide a light-sensitive silver halide X-ray photographic material improved in pressure resistance.

A third object of the present invention is to provide a light-sensitive silver halide X-ray photographic material having a high diagnostic performance.

Other objects will become apparent from the following description.

The above objects of the present invention can be achieved by the following. The present invention has been thus accomplished.

The objects can be achieved by a light-sensitive silver halide X-ray photographic material, having sensitometric properties in which a gamma (γ1) formed by a straight line portion between two points 0.5 and 1.5 of optical density is 2.7 to 3.3 and a gamma (γ2) formed by a straight line portion between points 2.0 and 3.0 of optical density is 1.5 to 2.5 in the characteristic curve of a rectangular coordinate system having equal coordinate axis unit lengths for the optical density (D) and the amount of exposure (log E); and containing a mixture of two or more kinds of tabular silver halide grains having an average aspect ratio of not less than 3.

DETAILED DESCRIPTION OF THE INVENTION

The present invention will be described below in detail.

In the gamma referred to in the present invention, the slope of a straight line connecting the point of the density of base (support) density +0.5 and the point of the density of base (support) density +1.5 on the characteristic curve is represented by $\gamma 1$, and the slope of a straight line similarly connecting the point of the density of base (support) density +2.0 and the point of the density of base (support) density +3.0 is represented by $\gamma 2$.

The angle at which these straight lines and the exposure axis (log E) fall being $\theta$, the gamma is defined by $\gamma = \tan \theta$.

The values of the above $\gamma 1$ and $\gamma 2$ according to the present invention are important for achieving the object of the present invention. The latitude of exposure at the low-density portion can be broadened by controlling the $\gamma 1$ to be 2.7 to 3.3, and preferably 2.80 to 3.3. The sharpness can be increased and also the latitude of exposure at the high-density portion can be broadened by controlling the $\gamma 2$ to be 1.5 to 2.5, and preferably 1.80 to 2.40.

It was unexpectable that this constitution has achieved an improvement in graininess and an improvement in resistance to pressure (in particular, pressure desensitization).

As an embodiment for the working of the present invention, a light-sensitive silver halide photographic material may be obtained in which the $\gamma 1$ is 2.7 to 3.3 and the $\gamma 2$ is 1.5 to 2.5 in the characteristic curve on the aforesaid rectangular coordinate axes, obtained when processed under photographic processing conditions as shown below.

Processing conditions

Using the following developing solution-1, a light-sensitive material is processed with a roller transport type automatic processor, according to the processing steps shown below.

| Developing solution-1 | |
|---|---|
| Potasium sulfite | 55.0 g |
| Hydroquinone | 25.0 g |
| 1-Phenyl-3-pyrazolidone | 1.2 g |
| Boric acid | 10.0 g |
| Potassium hydroxide | 21.0 g |
| Triethylene glycol | 17.5 g |
| 5-Methylbenzotriazole | 0.04 g |
| 5-Nitrobenzimidazole | 0.11 g |
| 1-Phenyl-5-mercaptotetrazole | 0.015 g |
| Glutaraldehyde bisulfite | 15.0 g |
| Glacial acetic acid | 16.0 g |
| KBr | 4.0 g |
| Made up to 1 liter by adding water. | |

Fixing Solution

XF-SR (trade name; produced by Konica Corporation)

Processing steps

Developing: Temperature 35° C.

Fixing: Temperature 33° C.

Dry-to-dry processing is carried out for 45 seconds using an automatic processor SRX-501 (trade name; manufactured by Konica Corporation).

Of the above conditions, the composition of the developing solution and the processing temperature and time may have some permitted freedom.

The characteristic curve may alternatively be a characteristic curve obtained by processing carried out under the same conditions as the above except that the developing solution-1 is replaced with a developing solution XD-SR (trade name; produced by Konica Corporation.

Exposure conditions are as follows: The light-sensitive silver halide photographic material according to the present invention, having emulsion layers on both side of its transparent support, is inserted between two pieces of optical wedge having a density gradation mirror-symmetrically adjusted, and then exposed to light for 1/10 second using a light source with a color temperature of 5,400° K., simultaneously from both sides and in equal amounts. Exposure conditions are by no means limited to the above, and any conditions are available so long as they are exposure conditions for the sensitometry used for light-sensitive silver halide X-ray photographic materials.

The silver halide emulsion used in the present invention contains tabular silver halide grains having an average aspect ratio of not less than 3, preferably tabular grains having an average aspect ratio of 3 to 20, and more preferably 3 to 15.

The size of the tabular grains may be not smaller than 0.3 μm, and preferably 0.3 to 4 μm.

The aspect ratio herein referred to is represented by a ratio of the diameter of a tabular grain to the thickness thereof. The diameter of the grain means a diameter of a circle having the same area as a projected area of a grain when observed with a microscope. The thickness thereof is indicated as a distance of two parallel planes that constitute a tabular grain.

The light-sensitive silver halide photographic material according to the present invention comprises silver halide grains comprised of such tabular grains in combination of at least two kinds.

In mixing two or more kinds of tabular grains, they may be mixed preferably in such a ratio that tabular grains of not smaller than 0.5 μm in average grain size are contained in a proportion of not less than 50%, mope preferably, tabular grains of 0.5 μm to 2.0 μm in an average grain size are contained in a proportion of not less than 60% and tabular grains of 0.2 μm to 0.5 μm in a proportion of not more than 40%, and most preferably, tabular grains of 0.6 μm to 1.5 μm in an average grain size are contained in a proportion of not less than 70% and tabular grains of 0.3 μm to 0.5 μm in a proportion of not more than 30%.

The aspect ratio of the tabular grains may be not less than 3, and, from the viewpoint of a practical demand, may be 5 to 8 or 8 or more.

These tabular silver halide grains may be held preferably in a proportion of not less that 50%, more preferably not less than 70%, and most preferably not less than 90%, based on the total projected areas.

The tabular grains may be composed of a silver halide such as silver bromide, silver iodobromide or silver iodochlorobromide. In the case of silver iodobromide, silver iodide may be contained usually in an amount of not more than 40 mol %, preferably not more than 20 mol %, and more preferably not more than 15 mol %.

These tabular silver halide grains may be prepared by the method as disclosed in, for example, U.S. Pat. Nos. 4,434,226, 4,439,520, 4,414,310, 4,425,425, 4,399,215, 4,435,501, 4,386,156, 4,400,463, 4,414,306 and 4,425,426, EP 84637 A2, Japanese Patent O.P.I. Publication No. 99433/1984 or RD-22534 (1983.1), or any methods similar thereto.

Emulsions may be subjected to washing such as noodle washing or flocculation precipitation so that soluble salts can be removed. A preferred method for washing can be exemplified by the method disclosed in Japanese Patent Examined Publication No. 16086/1960 which makes use of an aldehyde resin of an aromatic hydrocarbon type containing a sulfo group. A particularly preferred desalting method may include the method disclosed in Japanese Patent O.P.I. Publication No. 158644/1988 which makes use of a flocculating polymer agent as exemplified by G3, G8, etc.

In the tabular silver halide emulsion according to the present invention, various kinds of photographic additives can be used before or after physical ripening or chemical ripening is carried out.

Known additives include the compounds as disclosed in, for example, Research Disclosures No. 17643 (December 1978) and No. 18716 (November 1979).

kinds of the compounds disclosed in these two Research Disclosures and the paragraphs or columns in which they are described are shown in the following table.

| | RD-17643 | | RD-18716 | |
|---|---|---|---|---|
| Additives | Page | Paragraph | Page | Column |
| Chemical sensitizer: | 23 | III | 648 | right, upper |
| Spectral sensitizer: | 23 | IV | 648<br>649 | right to<br>left |
| Development accelerator: | 29 | XXI | 648 | right, upper |
| Antifoggant: | 24 | VI | 649 | right, lower |
| Stabilizer: | 24 | VI | 649 | right, lower |
| Anti-color-stain agent: | 25 | VII | 650 | left to right |
| Image stabilizer: | 25 | VII | | |
| Ultraviolet absorbent: | 25–26 | VIII | 649<br>650 | right to<br>left |
| Fliter dye: | 25–26 | VIII | 649 | right to left |
| Brightener: | 24 | V | | |
| Hardening agent: | 26 | X | 651 | left |
| Coating auxiliary: | 26–27 | XI | 650 | right |
| Surfactant: | 26–27 | XI | 650 | right |
| Plasticizer: | 27 | XII | 650 | right |
| Lubricant: | 27 | XII | | |
| Antistatic agent: | 27 | VII | 650 | right |
| Matting agent: | 28 | XVI | 650 | right |
| Binder: | 26 | IX | 651 | left |

A support that can be used in the light-sensitive material according to the present invention includes, for example, those disclosed in the above RD-17643, page 28, and RD-18716, page 647, left column.

Suitable supports are plastic films or the like. The surfaces of these supports may usually be provided with an under coat layer or subjected to corona discharging, ultraviolet irradiation or the like for the purpose of improving the adhesion of coating layers. Then the surface of any of the supports thus treated may be coated on its one side or both sides with the emulsion according to the present invention.

The present invention can be applied to all sorts of light-sensitive silver halide photographic materials. In particular, it is suited for black and white light-sensitive materials with a high sensitivity.

In instances in which the present invention is applied to X-ray radiography for medical use, a fluorescent screen is used which is mainly composed of a fluorescent substance capable of emitting near infrared light or visible light as a result of, for example, exposure to transmission radiation. This screen is preferably brought into close contact with both sides of a light-sensitive material coated on its both sides with the emulsion of the present invention.

The transmission radiation herein referred to is a high-energy electromagnetic wave, and means X-rays and gamma rays.

The fluorescent screen refers to an intensifying screen containing, for example, calcium tungstate as a main fluorescent component, or a fluorescent screen containing a terbium-activated rare earth element compound as a main component.

EXAMPLES

Examples of the present invention will be given below. As a matter of course, the present invention is by no means limited by the examples described below.

Example 1

(1) Preparation of grains:

Using as nuclei monodisperse grains of silver iodobromide containing 2.0 mol % of silver iodide with an average grain size of 0.2 μm, silver iodobromide containing 30 mol % of silver iodide was made to grow under conditions of pH 9.8 and pAg 7.8, followed by addition of potassium bromide and silver nitrate in equimolar amounts under conditions of pH 8.2 and pAg 9.1 to prepare two kinds of spherical monodisperse emulsion grains of 0.73 μm [(1)-a] and 0.41 μm [(1)-b] in average grain size, comprised of silver iodobromide grains so prepared as to have an average silver iodide content of 2.2 mol %. The emulsion was desalted by conventional flocculation to remove excess salts. More specifically, the emulsion was maintained at 40° C., and a formalin condensate of sodium naphthalene sulfonate and an aqueous solution of magnesium sulfate were added thereto to effect flocculation. After the supernatant was removed, pure water of not higher than 40° was further added and then an aqueous solution of magnesium sulfate was again added to effect flocculation, followed by removal of the supernatant. Both of the two kinds of silver halide grains thus obtained had a coefficient of variation of 16% and also had good mono-dispersibility.

(2) Preparation of grains:

| (preparation of spherical seed emulsion) | |
|---|---|
| A1: | |
| Ossein gelatin | 150 g |
| Potasium bromide | 53.1 g |
| Potassium iodide | 24 g |
| Adding water, made up to | 7.2 lit |
| B1: | |
| Silver nitrate | 1.5 kg |
| Adding water, made up to | 6 lit |
| C1: | |
| Potassium bromide | 1,327 g |
| 1-Phenyl-5-mercaptotetrazole (dissolved with methanol) | 1.2 g |
| Adding water, made up to | 3 lit |
| D1: | |
| Ammonia water (28%) | 705 ml |

To the solution A1 vigorously stirred at 40° C., the solutions B1 and C1 were added in 30 seconds by double-jet precipitation to effect formation of nuclei. At this time the pBr was 1.09 to 1.15.

After 1 minute 30 seconds, C1 was added in 20 seconds, followed by ripening for 5 minutes. At the time of the ripening, KBr was in a concentration of 0.071 mol/lit, and ammonia in a concentration of 0.63 mol/lit.

Thereafter, the pH was adjusted to 6.0, and desalting was carried out in the same manner as previously described. The seed emulsion thus obtained was observed with an electron microscope to confirm that the emulsion was a spherical monodisperse emulsion having an average grain size of 0.26 μm and a coefficient of variation of 18%. Next, this emulsion was grown by the method as described below.

Using the above seed emulsion and three kinds of solutions shown below, silver halide emulsions mainly composed of tabular twinned crystals were prepared.

| | |
|---|---|
| A2: | |
| Ossein gelatin | 37 g |
| Disodium propyleneoxy-polyethyleneoxy-disuccinate (10% methanol solution) | 10 ml |
| Seed emulsion of Example 1 | corr. to 0.191 mol |
| Adding water, made up to | 4,000 ml |
| B1: | |
| Ossein gelatin | 109 g |
| Potassium bromide | 804 g |
| Potassium iodide | 23.1 g |
| Adding water, made up to | 4,628 ml |
| C2: | |
| Solver nitrate | 1,168 g |
| Adding water, made up to | 6,248 ml |

To the solution A2 vigorously stirred at 65° C., the solutions B2 and C2 were added in 112 minutes by double-jet precipitation. In the course of this addition, the pH and pAg were always maintained at 5.8 and 9.0, respectively. The rate of addition of solutions B2 and C2 was linearly increased so that the initial rate becomes 6.4 times at the final stage.

After the addition was completed, the pH was adjusted to 6.0. The emulsion thus obtained was observed with an electron microscope to confirm that the emulsion had an average grain size of 1.2 μm [(2)-a].

In the same manner as the above, emulsions of 0.72 μm [(2)-b] and 0.41 μm [(2)-c] in average grain size were prepared. The three kinds of emulsions thus obtained were all comprised of tabular silver halide grains having an average aspect ratio of 4.9 and a coefficient of variation of 19%. The emulsions thus obtained were again desalted in the same manner as previously described.

(3) Preparation of grains:

(Preparation of seed emulsion)

In 1,000 ml of water, 7 g of deionized alkali-treated gelatin and 4 g of KBr were dissolved and thereafter the pH was adjusted to 6.0. While the temperature of the solution was maintained at 25° C., 160 ml of aqueous $AgNO_3$ solution (containing 32.6 g of $AgNO_3$) and 160 ml of aqueous KBr solution (containing 24.08 g of KBr) were simultaneously added over a period of 4 minutes (flow rate: 40 ml/min), and the mixture was stirred for 2 minutes. Immediately thereafter, desalting and washing were carried out in the same manner as the preparation (1). The seed emulsion thus obtained was a spherical monodisperse emulsion having an average grain size of 0.08 μm and a coefficient of variation of 18%.

Using the above seed emulsion, grains were grown in the same manner as the preparation (2) to give an emulsion. The emulsion, (3)-a, thus obtained had an average grain size of 0.40 μm, an average aspect ratio of 10.3 and a coefficient of variation of 28 %.

Emulsion (1), (2) and (3) were thus prepared, and the spectral sensitizer (1) described later was added thereto in an amount of 400 mg per mol, at the stage of the respective desalting steps.

Preparation of samples, processing, and evaluation

To the silver halide grains (1), (2) and (3) each thus obtained, pure water was added so as to give a volume of 500 ml per mol, and the mixture was maintained at 55° C. Ammonium thiocyanate, chloroauric acid and hypo, as well as spectral sensitizers (1) and (2) were added to carry out chemical ripening under conditions capable of obtaining a maximum sensitivity. This chemical ripening was carried out at a pH of 6.15 and a silver potential of 50 mV.

Next, 4-hydroxy-6-methyl-1,3,3a, 7-tetrazaindene was added in an appropriate amount to give emulsions.

The above emulsions were mixed in a mixing proportion as shown in Table 1, followed by addition of the photographic emulsion coating additives as set out later. Preparation solutions (emulsion coating solutions) were thus prepared.

These photographic emulsion coating solutions were prepared by using sodium carbonate and potassium bromide so that they had a pH of 6.40 and a silver potential of 74 mV (35° C.) after their preparation. Using these emulsion coating solutions, samples were prepared in the following way: Using two sets of slide hopper type coaters, a support was coated thereon with the emulsion coating solution by both-side simultaneous coating so as for an emulsion layer to contain 2.0 g/m$^2$ of gelatin per one side and have a silver weight of 2.3 g/m$^2$ per one side in terms of silver. A coating solution for a protective layer was also prepared using the additives as set out later, and coated so as for the protective layer to have a gelatin coating weight of 1.15 m/g$^2$. As the support, a 175 μm thick polyethylene terephthalate film was used, which had been coated with a subbing solution comprising a water-based copolymer dispersion obtained by diluting to a concentration of 10% by weight a copolymer comprising three kinds of monomers of 50% by weight of glycidyl dimethacrylate, 10% by weight of methyl acrylate and 40% by weight of butyl methacrylate.

Spectral sensitizer (1)

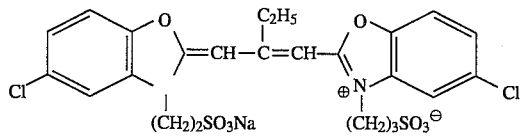

-continued

Spectral sensitizer (2)

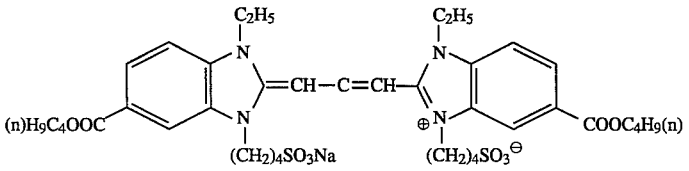

To each emulsion layer, the following additives are added in the amounts per mol of silver.

| | |
|---|---|
| t-Butylcathecol | 400 mg |
| Polyvinyl pyrrolidone (molecular weight: 10,000) | 1.0 g |
| Trimethylolpropane | 10 g |
| Styrene-maleic anhydride copolymer | 2.5 g |
| Diethylene glycol | 5 g |
| Nitrophenyl-triphenylphosphonium chloride | 50 mg |
| Ammonium 1,3-hydroxybenzene-4-sulfonate | 4 g |
| Sodium 2-mercaptobenzimidazole-5-sulfonate | 15 mg |
| 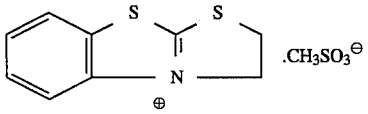 | 70 mg |
| 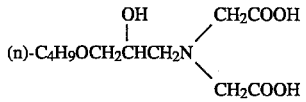 | 1 g |
| 1,1-Dimethylol-1-bromo-1-nitromethane | 10 mg |

To the protective layer, the following compounds were added in the amounts per 1 g of gelatin.

| | |
|---|---|
| 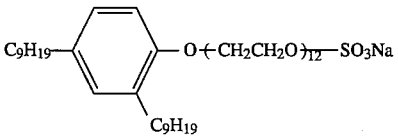 | 10 mg |
| 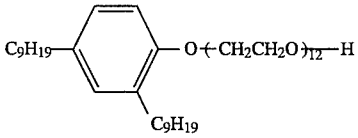 | 2 mg |
| $CH_2COO(CH_2)_9CH_3$ \| $CHCOO(CH_2)_2CH(CH_3)_2$ \| $SO_3Na$ | 7 mg |
| $C_9F_{19}-O\leftarrow CH_2CH_2O-)_{10}CH_2CH_2OH$ | 2 mg |
| $C_8F_{17}SO_3K$ | 3 mg |
| 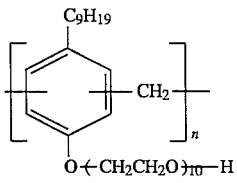 n = 4 to 7 | 15 mg |

-continued

| | |
|---|---|
| Polymethyl methacrylate (a matting agent) with an average particle diameter of 5 μm | 7 mg |
| Colloidal silica (average particle diameter: 0.013 μm) | 70 mg |
| Bis(vinyl sulfonylmethyl) ether | 7 mg |
| Aqueous 35% formaldehyde solution | 3 mg |
| Aqueous 45% glyoxal solution | 2 mg |

Sensitometry

The samples obtained were each inserted between fluorescent screens KO-250 (trade name; produced by Konica Corporation). Sensitometry characteristic curve was prepared by the range method at a tube voltage of 90 KVP, and the sensitivity, γ1 and γ2 were determined. Processing was carried out using Konica Automatic Processor SRX-501 and also using a developing solution XD-SR and a fixing solution XF-SR (both trade names; produced by Konica Corporation).

The developing was carried out at a temperature of 35° C. for a time period of 15 seconds, and the fixing at a temperature of 33° C. Washing water was supplied at 18° C. in an amount of 1.5 lit per minute. The processing was carried out in a total processing time of 45 seconds.

Evaluation of sharpness

To evaluate the sharpness, a Funk test chart SMS5853 (trade name; produced by Konica Medical Corporation) was used, which was processed at the same tube voltage, using the same intensifying screens and under the same conditions as the sensitometry. As to the amount of exposure, each sample was exposed so as to be 1.30±0.02 in average density of the light and shade produced by the Funk test chart.

Evaluation of pressure desensitization resistance

Samples were moisture-conditioned for 2 hours under conditions of a temperature of 23° C. and a relative humidity of 35%, and thereafter folded by about 280° with a curvature radius of 2 cm under the same conditions. Subsequently, after 3 minutes, the folded samples were exposed to X-rays for 0.06 second using an aluminum wedge under conditions of a tube voltage of 80 KV and a tube current of 100 mA, and then processed in the same manner as the aforesaid sensitometry. The stated resistance was visually evaluated.

Evaluation of graininess

Using the above samples prepared for the evaluation of pressure desensitization resistance, the graininess was visually evaluated.

The visual evaluation of the pressure desensitization resistance and graininess was made according to the five grade system, in which 5 is the best and 1 is the worst.

Results obtained are shown in Table 1 below.

TABLE 1

| Sample No. | Emulsion mixing ratio (%) (1)-a | (1)-b | (2)-a | (2)-b | (2)-c | (3)-a | λ1 | λ2 | Sensitivity | MTF | Graininess | pressure desinsitization |
|---|---|---|---|---|---|---|---|---|---|---|---|---|
| 1 | 80 | 20 | 0 | 0 | 0 | 0 | 3.20 | 2.35 | 100 | 0.50 | 1 | 1 |
| 2 | 60 | 40 | 0 | 0 | 0 | 0 | 3.05 | 2.75 | 90 | 0.52 | 2 | 1 |
| 3 | 60 | 0 | 0 | 0 | 40 | 0 | 3.02 | 2.70 | 92 | 0.55 | 3 | 2 |
| 4 | 70 | 0 | 10 | 0 | 20 | 0 | 2.90 | 2.30 | 105 | 0.54 | 3 | 3 |
| 5 | 0 | 0 | 10 | 70 | 20 | 0 | 2.85 | 2.28 | 118 | 0.60 | 5 | 5 |
| 6 | 0 | 0 | 10 | 70 | 0 | 20 | 2.85 | 2.35 | 120 | 0.63 | 5 | 5 |
| 7 | 70 | 20 | 10 | 0 | 0 | 0 | 2.88 | 2.27 | 103 | 0.53 | 3 | 3 |
| 8 | 90 | 10 | 0 | 0 | 0 | 0 | 3.30 | 1.85 | 105 | 0.51 | 1 | 1 |
| 9 | 0 | 10 | 0 | 90 | 0 | 0 | 3.27 | 1.83 | 125 | 0.58 | 4 | 4 |
| 10 | 0 | 0 | 0 | 90 | 10 | 0 | 3.27 | 1.81 | 127 | 0.60 | 5 | 5 |
| 11 | 0 | 0 | 0 | 90 | 0 | 10 | 3.30 | 1.90 | 129 | 0.62 | 5 | 5 |
| 12 | 0 | 0 | 0 | 80 | 20 | 0 | 3.30 | 2.30 | 120 | 0.62 | 5 | 5 |
| 13 | 0 | 0 | 0 | 80 | 0 | 20 | 3.18 | 2.28 | 123 | 0.64 | 5 | 5 |

As is clear from Table 1, the samples according to the present invention have a high sensitivity, are free from deterioration of the sharpness and graininess, and are improved in the pressure desensitization resistance.

Thus the present invention has brought about a light-sensitive silver halide photographic material improved in the sharpness and graininess of images and causing less pressure desensitization resistance, which is effective as light-sensitive materials for X-ray photography.

What is claimed is:

1. A light-sensitive silver halide X-ray photographic material comprising an emulsion containing a mixture of at least two kinds of tabular silver halide grains, containing tabular silver halide grains of 0.6 μm to 1.5 μm in an average grain size in a proportion of 70% to 95% and of 0.3 μm to 0.5 μm in a proportion of 5% to 30%; the aspect ratio of the tabular grains in said mixture is not less than 3;

and having sensitometric properties in which a gamma (γ1) formed by a straight line portion between two points 0.5 and 1.5 of optical density is 2.7 to 3.3 and a gamma (γ2) formed by a straight line portion between points 2.0 and 3.0 of optical density is 1.5 to 2.5 in the characteristic curve of a rectangular coordinate system having equal coordinate axis unit lengths for the optical density (D) and the amount of exposure (log E) .

2. The material of claim 1, wherein said tabular grains have an average aspect ratio of 3 to 20.

3. The material of claim 2, wherein said tabular grains have an average aspect ratio of 5 to 8.

4. The material of claim 1, wherein said γ1 is 2.8 to 3.3, and γ2 is 1.8 to 2.4.

5. The material of claim 1 wherein the at least two kinds of tabular silver halide grains are present in a proportion of not less than 50%, based on the total projected areas of all silver halide grains.

6. The material of claim 5 wherein said proportion is not less than 70%.

7. The material of claim 6 wherein said proportion is not less than 90%.

8. The material of claim 1 wherein said tabular silver halide grains comprise not more than 40 mol % of silver iodide.

9. A light-sensitive silver halide X-ray photographic material comprising an emulsion containing a mixture of at least two kinds of tabular silver halide grains wherein tabular silver halide grains of 0.6 μm to 1.5 μm in an average grain size are contained in a proportion of 70% to 95% and of 0.3 μm to 0.5 μm in a proportion of 5% to 30%; the aspect ratio of tabular grains in said mixture is 3 to 20;

and having sensitometric properties in which a gamma (γ1) formed by a straight line portion between two points 0.5 and 1.5 of optical density is 2.8 to 3.3 and a gamma (γ2) formed by a straight line portion between points 2.0 ana 3.0 of optical density is 1.8 to 2.4 in the characteristic curve of a rectangular coordinate system having equal coordinate axis unit lengths for the optical density (D) and the amount of exposure (log E).

* * * * *